United States Patent [19]

Beer

[11] Patent Number: 4,603,447

[45] Date of Patent: Aug. 5, 1986

[54] DISK TYPE BRUSH

[75] Inventor: Carl C. Beer, Philadelphia, Pa.

[73] Assignee: Sherman Industries, Inc., Palmyra, N.Y.

[21] Appl. No.: 703,170

[22] Filed: Feb. 19, 1985

[51] Int. Cl.[4] ..... B24D 13/06; B24D 13/10; B60S 13/06

[52] U.S. Cl. ..... 15/97 B; 15/DIG. 2; 15/230.14; 15/230.16

[58] Field of Search ..... 15/97 B, 181, 179, 230, 15/230.14, 230.16, DIG. 2, 21 D, 21 E, 53 A, 53 AB, 97 R, 230.17, 230.19

[56] References Cited

U.S. PATENT DOCUMENTS

| | | | |
|---|---|---|---|
| 2,280,399 | 4/1942 | Garling | 51/193 |
| 2,290,575 | 7/1942 | Potter | 15/181 |
| 2,508,065 | 5/1950 | Hendrickson | 51/193 |
| 2,562,688 | 7/1951 | Bahr | 51/193 |
| 2,651,151 | 9/1953 | Hendrickson | 51/193 |
| 2,744,277 | 5/1956 | Peterson | 15/181 |
| 3,857,135 | 12/1974 | Takeuchi | 15/230.14 |
| 4,531,252 | 7/1985 | Arnal | 15/181 |

*Primary Examiner*—Edward L. Roberts

*Attorney, Agent, or Firm*—Seidel, Gonda, Goldhammer & Abbott

[57] ABSTRACT

A brush having a circular disk with a plurality of slots adjacent the edge of the disk. The slots are elongated and arranged at spaced locations around the circumference of the disk. The disk has brush elements made up of individual elongated cloth strips secured to the disk by the circumferential slots. A central opening couples the disk to a drive shaft for rotation of the disk.

11 Claims, 6 Drawing Figures

FIG. 1A
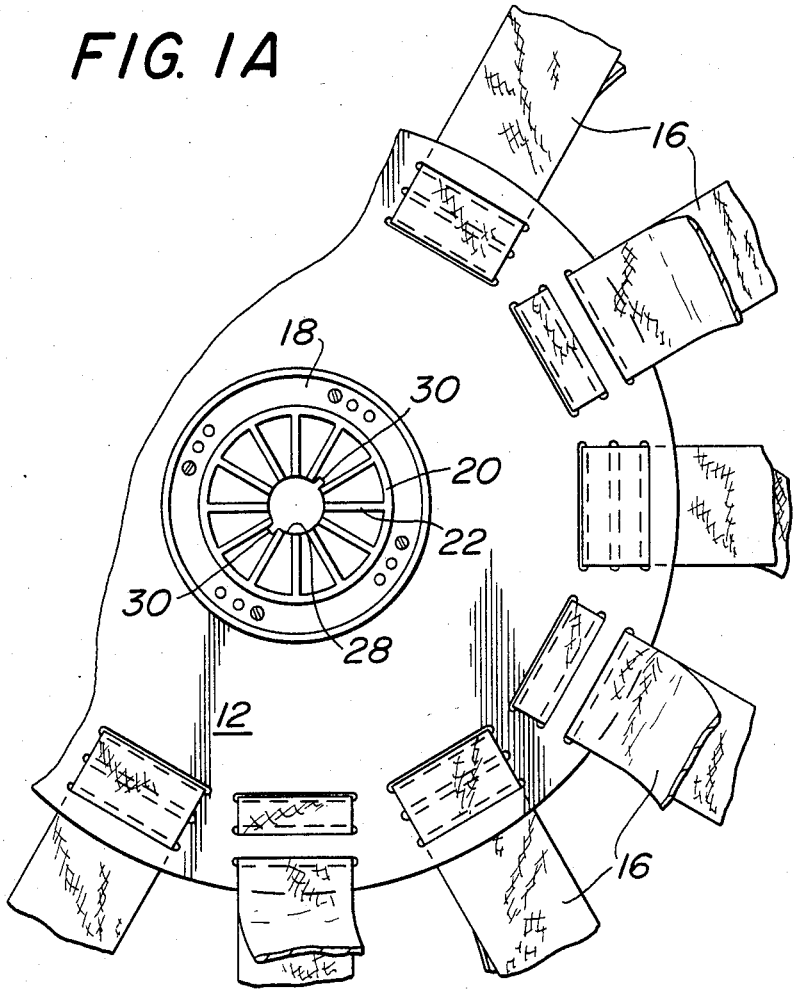
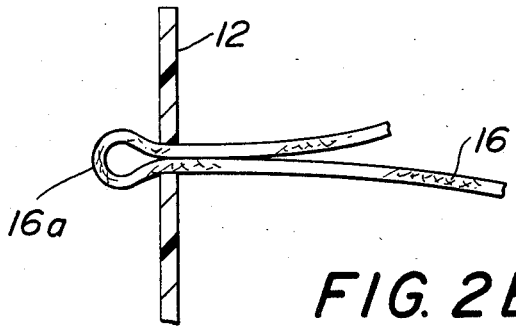
FIG. 2B

DISK TYPE BRUSH

BACKGROUND OF THE INVENTION

The present invention is directed to a brush having soft, flexible brush elements frictionally secured to a circular disk without fastening hardware.

The brush of the present invention is particularly useful in automated commercial car washes, although the invention may be advantageously used in any brushing application.

Commercial automated car wash establishments have for years used bristle-type brushes for scrubbing cars to be washed. The bristles used were necessarily stiff and coarse because the brushes had to withstand severe and prolonged use. The disadvantage of this type of brush, however, is that the coarse bristles can scratch the finish of the surface of a vehicle being washed, detracting from the appearance of the washed vehicle. In addition, because the bristle brushes are relatively stiff, they pose a hazard to hood ornaments, antennas and the like.

There has long been a need for a flexible brush that effectively cleans the surface of a vehicle to be washed but does not pose a danger of scratching or damaging the vehicle.

A number of unsatisfactory attempts at providing such a brush having been made in the past. For example, U.S. Pat. Nos. 2,280,399, 2,508,065, 2,562,688 and 2,651,151 all disclose buffing wheels which have flexible buffing elements removably attached to a central mounting disk. Without exception, however, these patents require some sort of fastening means to secure the buffing elements to the disk. In addition to the obvious high degree of complexity and cost of such brushes, such brushes pose a safety problem. When the brushes are rotated at high speed, there is always the danger that a fastening element may become dislodged and be thrown from the brush, causing a hazard to people and machinery.

It is an object of the present invention to provide a brush with flexible brushing elements which offers all of the advantages of a flexible brush while entirely avoiding the disadvantages of prior art brushes.

It is also an object of the invention to provide a brush suitable for use in an automated car wash which provides effective scrubbing without the danger of scratching or damaging the vehicle and projections such as hood ornaments, antennas, mirrors and the like.

It is a further object of the invention to provide a brush whose diameter may be easily adjusted to permit simple field adjustment for brush wear.

It is another object of the invention to provide a brush in which the brush elements can be easily replaced in the field without tools and without the necessity of removing the brush from its mounting shaft.

It is still another object of the invention to provide a brush which permits variable stacking of brush disks for controlled brush density.

It is yet another object of the invention to provide a flexible brush in which no fastening hardware is required for mounting the brush elements to the disks.

These and other objects and advantages will appear hereinafter.

SUMMARY OF THE INVENTION

The present invention is a brush comprising a circular disk having at least one opening adjacent the outer rim of the disk and at least one flexible brush element frictionally secured to the disk by passing at least a portion of the brush element through the opening. The brush has means adjacent the center of the disk for coupling the disk to a drive means for rotating the disk.

In one preferred embodiment of the invention, the brush comprises a circular disk having a plurality of generally elongated openings, or slots, adjacent the outer rim of the disk and arranged in groups of at least two slots at spaced intervals around the circumference of the disk. Generally elongated flexible brush elements are frictionally secured to the disk by passing the brush elements through the slots whereby friction between the interior surface of the slots and the brush element secures the brush element in place.

For the purpose of illustrating the invention, there is shown in the drawings a form which is presently preferred; it being understood, however, that this invention is not limited to the precise arrangements and instrumentalities shown.

DESCRIPTION OF THE DRAWINGS

FIG. 1A is a detail of the brush of FIG. 1, showing the means for coupling the disk to a shaft.

FIG. 2B is a detail of FIG. 2, showing an alternate attachment of the brush elements to the disk.

DESCRIPTION OF THE INVENTION

Figure 1:
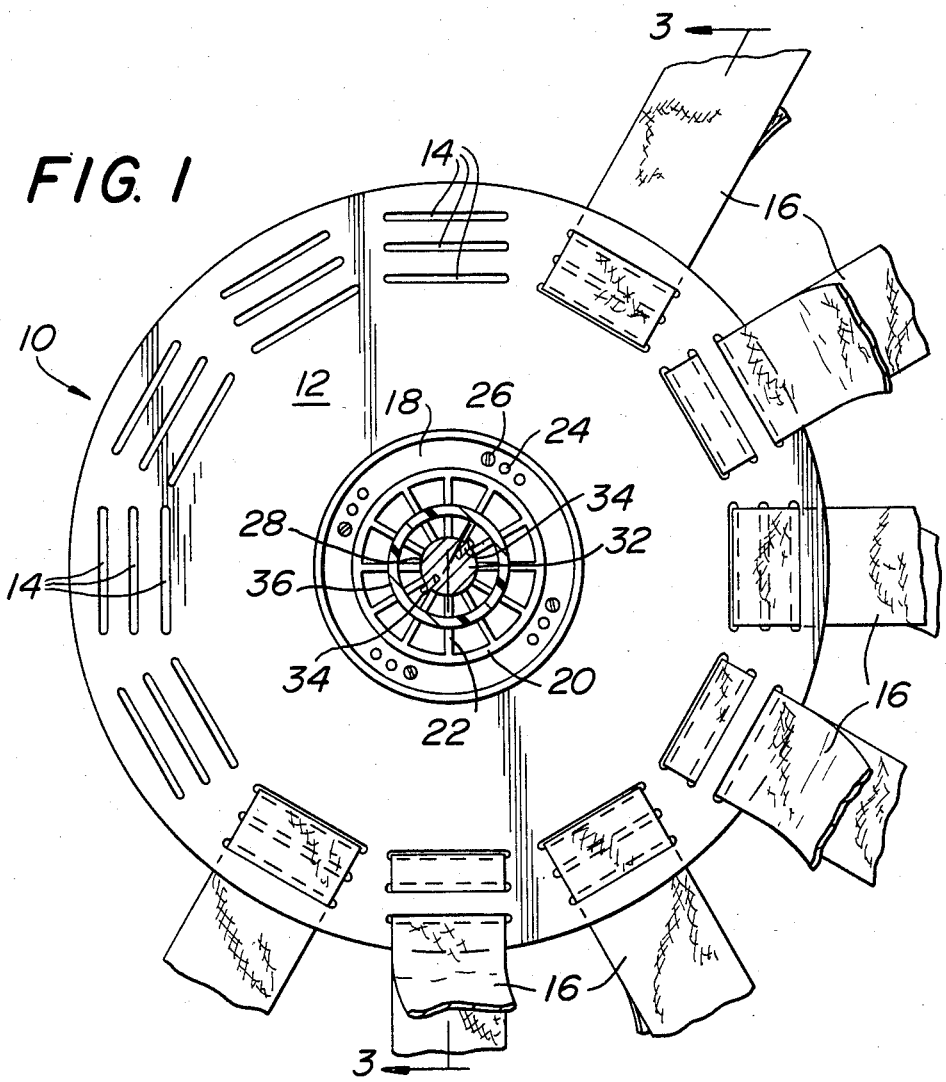
FIG. 1 is a side elevational view of a disk brush embodying features of the present invention.

Referring now to the drawings, wherein like numerals indicate like elements, there is shown in FIG. 1 a disk-type brush 10 in accordance with the present invention. In the illustrated embodiment, the brush 10 has a flat circular disk 12 with a plurality of generally elongated openings or slots 14 adjacent the outer rim of the disk and arranged at spaced intervals around the circumference of the disk. In the illustrated embodiment, the slots 14 are arranged in groups of three. It is felt that three slots are most desirable for securing the brush elements 16, although any number of slots may be used.

Figure 2A:
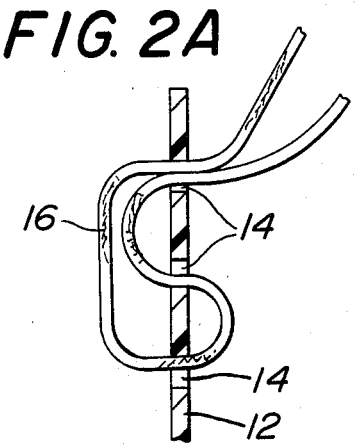
FIG. 2A is a detail of FIG. 2, showing attachment of the brush elements to the disk.

Brush elements 16 may be of cloth or of non-woven synthetic fabric. Brush elements 16 are secured to disk 12 by threading the element 16 through slots 14 and pulling the ends tightly. As shown in FIG. 2A, brush element 16 is threaded through inner-most slot 14 to approximately its mid-point. A first end of brush element 16 is then threaded through outermost 14, while the second end of brush element 16 is threaded in the opposite direction through center slot 14 and opposite again through outermost slot 14 together with the first end of brush element 16. By pulling tightly on the ends of brush element 16, the brush element can be tightly secured to disk 12 and held in place by friction between the brush element and the slots.

By threading the brush elements 16 through openings 14 in this manner, the brush elements can be tightly secured to the disk without the need for any type of fastening hardware whatever. This makes brush 10 extremely easy and inexpensive to manufacture, and at the same time, eliminates potential safety hazards in the form of a loose fastener which can be thrown from the brush when in use.

Although groups of three slots are preferred, the invention is not limited to a particular number of slots. Brush elements 16 can be effectively secured to disk 12 by any number of slots, including one slot, in which case the brush element 16 is simply doubled over and the free ends inserted through the slot 14, as shown in FIG. 2B. By doubling over the brush elements in this fashion, a bulbous end 16*a* is formed, which prevents brush element 16 from being pulled through opening 14 and which anchors element 16 securely in disk 12.

Brush elements 16 may be threaded alternately from opposite sides of disk 12, as shown in FIG. 1, so that the brush 10 is symmetrical as to either side. This gives brush 10 effectively a symmetrical brushing surface when in use.

The length of slots 14 is determined by the desired width of the brush elements 16. For example, the brush may be constructed with a large number of very thin brush elements or a smaller number of wider brush elements, as desired for different applications. The length of slots 14 is approximately equal to the width of brush elements 16. This prevents shifting of the brush elements in the slots. The width of slots 14 is preferably approximately twice the thickness of brush element 16 to provide the maximum amount of friction to securely anchor brush elements 16 in place. If the width of the slots is too small, it will be too difficult to thread brush elements 16 through the slots as required. If the width of the slots is too great, the brush elements can be easily dislodged.

Figure 2:
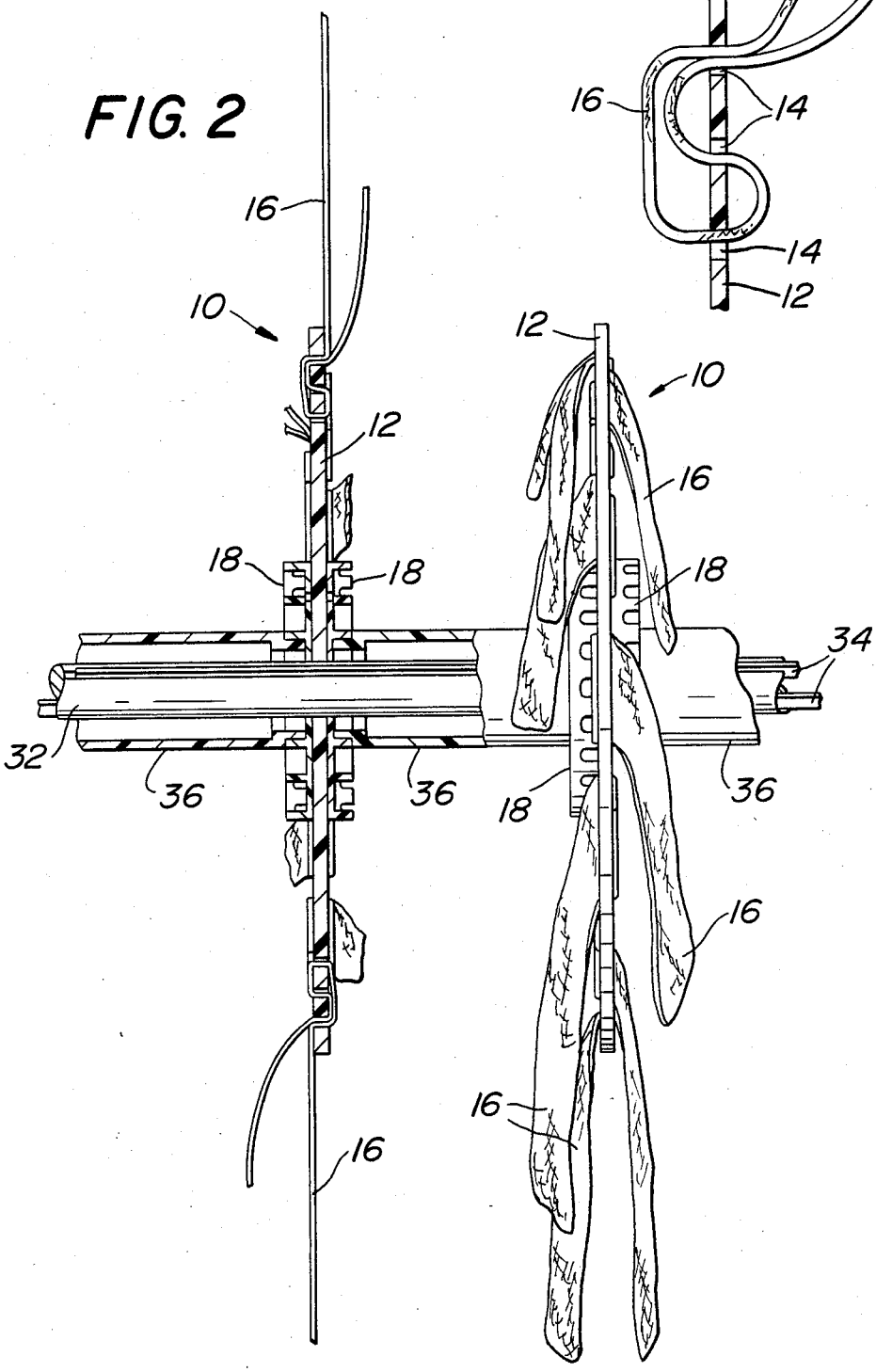
FIG. 2 is a vertical cross-sectional view of an assembly of a plurality of disk brushes on a shaft and adapted for operation, some parts being shown in elevation and other parts being broken away.

As best seen in FIG. 1A, disk 12 is provided with at least one mounting disk 18 by means of which disk 12 is secured to a drive shaft for imparting rotary motion to disk 12. Shaft 32 may be driven by any suitable means. Mounting disk 18 comprises a web 20 with a plurality of radial spokes 22 which surround a central opening 28. Opening 28 is provided with at least one keyway 30 for fixing disk 12 on the drive shaft and preventing relative rotation between the disk and the shaft. As shown in FIG. 2, disk 12 is mounted on a shaft 32 which has at least one key 34 which mates with keyway 30 in opening 28. Although a pair of keys and keyways is shown, any number will suffice.

Alternatively, instead of a key 34 and keyway 30, shaft 32 may be square, octagonal, or other similar non-circular shape, with opening 28 of the same shape. Such an arrangement would also prevent relative rotation between the disk 12 and shaft 32. Shaft 32 can also be provided with a flat surface (i.e., be substantially D-shaped in cross-section), and opening 28 can be made D-shaped as well.

Mounting disk 18 is secured to disk 12 by any suitable means, such as by mounting holes 18 and mounting screws 26, which pass through corresponding holes (not shown) in disk 12.

Although two mounting disks 18 are shown, a single mounting disk will also suffice.

By providing mounting disk 18 with a series of mounting holes 24 as shown, mounting disk 18 can be fixed to disk 12 in almost any angular orientation desired. This permits keyways 30 to be located at any desired position with respect to brush elements 16. This is advantageous when constructing an array of brushes so that the effective circumferential area of the brush array is continuous.

It will be understood that, as disk 12 is rotated by shaft 32, centrifugal forces on brush elements 16 will cause the elements to extend radially with respect to disk 12. As a rotating brush 10 is passed over a surface to be scrubbed, the ends of brush elements 16 impact the surface with sufficient force to achieve a scrubbing effect but lightly enough to avoid damaging the surface or objects projecting from the surface.

As shown in FIG. 2, any number of brushes 10 can be grouped together to form a brush array 50. Individual brushes 10 are mounted on shaft 32 and spaced apart by tubular spacers 36. By varying the length of spacers 36, any brush spacing, and therefore brush density, can be obtained.

Figure 3:
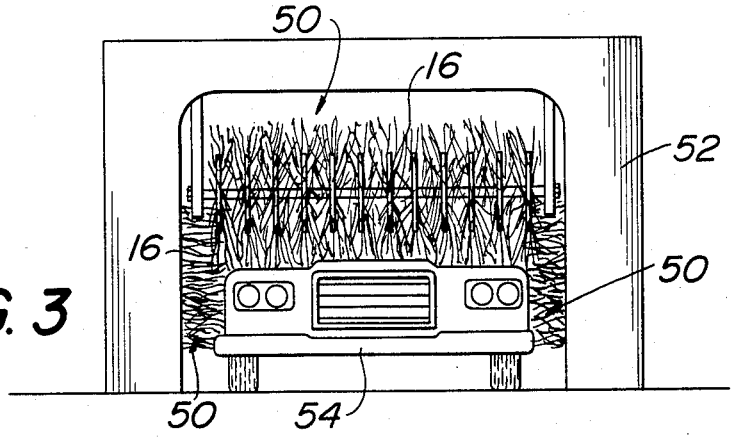
FIG. 3 illustrates an array of brushes adapted for use in a car wash.

FIG. 3 shows a brush array 50 mounted in a support arch for use in an automated car wash. The brush array 50 is mounted in a position relative to vehicle 54 so that, as the vehicle 54 is conveyed past the brush assembly by a conventional car wash conveyor (not shown) the brush elements 16 will contact the surfaces of the vehicle and provide the desired scrubbing effect. Brush array 50 may be mounted in any orientation with respect to horizontal and vertical so as to scrub the top and sides of the vehicle. In addition, any number of brush arrays 50 may be grouped together, for example, one or more mounted horizontally to scrub the hood, roof and trunk of vehicle 54 and two or more mounted vertically on each side of vehicle 54 to scrub the sides of the vehicle. Each array is rotated by its shaft 32, which can be driven by any suitable means.

Because brush elements 16 are flexible rather than stiff or rigid, a brush 10 and a brush array 50 have a self-adjusting feature. That is, brush 10 can scrub a surface at virtually any distance between the outer cricumference of disk 12 and the outer radial extent of brush elements 16. Brush 10 thus automatically compensates for wide variations in surface contours.

Brush 10 is very simple to repair in the field. As brush elements 16 wear and need to be replaced, the old elements are simply removed and new elements are threaded into disk 12 in their place without the need for removing brush 10 from shaft 32.

It will be appreciated that the present invention provides a brush which achieves all of the desired objects and advantages set forth above while completely avoiding the disadvantages of prior art brushes.

The present invention may be embodied in other specific forms without departing from the spirit or essential attributes thereof and, accordingly, reference should be made to the appended claims, rather than to the foregoing specification, as indicating the scope of the invention.

I claim:

1. A brush comprising generally elongated non-rigid brush elements arranged around the circumference of a circular disk, means integral with the disk for frictionally securing the brush elements to the disk consisting of a plurality of openings through the disk adjacent the outer rim of the disk and arranged in groups of at least two radially-spaced openings, the groups being at spaced intervals around the circumference of the disk, and coupling means adjacent the center of the disk for coupling the disk to a drive means for rotating the disk.

2. A brush according to claim 1, wherein the spaced intervals around the circumference are equal.

3. A brush according to claim 2, wherein the spaced intervals are 30°.

4. A brush according to claim 1, wherein the drive means comprises a shaft.

5. A brush according to claim 4, wherein the coupling means includes means for preventing relative rotation between the disk and the shaft.

6. A brush according to claim 5, wherein the means for preventing relative rotation between the disk and the shaft comprises key means on the shaft and keyway means on the coupling means.

7. A brush according to claim 1, wherein the brush elements are cloth.

8. A brush according to claim 1, wherein the brush elements are non-woven synthetic fabric.

9. A brush according to claim 1, wherein the brush elements have an elongated cross-section and the openings in the disk are elongated slots.

10. Apparatus for scrubbing the surface of a vehicle as the vehicle is conveyed along a path through a car wash, comprising:

(a) a plurality of brush arrays, each brush array comprising a central shaft, a plurality of individual brushes on said shaft, each individual brush comprising a circular disk having a plurality of generally elongated openings therethrough adjacent the outer rim of the disk arranged in groups of at least two slots at spaced intervals around the circumference of the disk, generally elongated brush elements frictionally secured to the disk by passing the brush elements through the slots, and coupling means adjacent the center of the disk for coupling the disk to the shaft and spacer means on said shaft between individual brushes;

(b) means for supporting the brush arrays so that the brush elements extend into the path of the vehicle; and (c) drive means for rotating the central shaft of each brush array.

11. A brush array comprising:

(a) a central shaft, (b) a plurality of individual brushes on said shaft, each individual brush comprising generally elongated non-rigid brush elements arranged around the circumference of a circular disk, means integral with the disk for frictionally securing the brush elements to the disk consisting of a plurality of openings through the disk adjacent the outer rim of the disk and arranged in groups of at least two radially-spaced openings, the groups being at spaced intervals around the circumference of the disk, (c) coupling means adjacent the center of each disk for coupling the disk to the shaft, and (d) spacer means on said shaft between individual brushes.

* * * * *